US007222604B2

(12) United States Patent
Anz

(10) Patent No.: US 7,222,604 B2
(45) Date of Patent: May 29, 2007

(54) METHOD AND DEVICE FOR CONTROLLING A DRIVE UNIT

(75) Inventor: Ruprecht Anz, Renningen (DE)

(73) Assignee: Robert Bosch GmbH, Stuittgart (DE)

( * ) Notice: Subject to any disclaimer, the term of this patent is extended or adjusted under 35 U.S.C. 154(b) by 0 days.

(21) Appl. No.: 11/303,104

(22) Filed: Dec. 16, 2005

(65) Prior Publication Data

US 2006/0157022 A1 Jul. 20, 2006

(30) Foreign Application Priority Data

Dec. 16, 2004 (DE) ..... 10 2004 060 527

(51) Int. Cl.
*F02D 45/00* (2006.01)
*F02D 41/16* (2006.01)

(52) U.S. Cl. ..... 123/339.16; 123/339.14

(58) Field of Classification Search ..... 123/339.1, 123/339.14, 339.16, 339.18, 339.2, 339.21
See application file for complete search history.

(56) References Cited

U.S. PATENT DOCUMENTS 6,349,236 B1 * 2/2002 Hansen et al. ..... 700/67
6,778,883 B1 * 8/2004 Gerhardt et al. ..... 701/1
6,795,755 B2 * 9/2004 Keilhofer et al. ..... 701/22
6,845,750 B2 * 1/2005 Matischuk et al. .... 123/339.19
6,873,891 B2 * 3/2005 Moser et al. ..... 701/48
6,945,221 B2 * 9/2005 Baeuerle ..... 123/319

* cited by examiner

*Primary Examiner*—Hai Huynh
(74) *Attorney, Agent, or Firm*—Kenyon & Kenyon LLP

(57) ABSTRACT

A method and a device for controlling a drive unit which allow an improved transition between idle regulation and drive unit propulsion are provided. A setpoint value for an output variable of the drive unit is predefined, it being possible to modify the setpoint value as a function of at least one reducing request and as a function of at least one load to be compensated for. The ratio of a first priority request for the modification of the predefined setpoint value as a function of the at least one load to be compensated for to a second priority request for the modification of the predefined setpoint value as a function of the at least one reducing request may be varied for different drive unit operating states.

10 Claims, 2 Drawing Sheets

Fig. 1
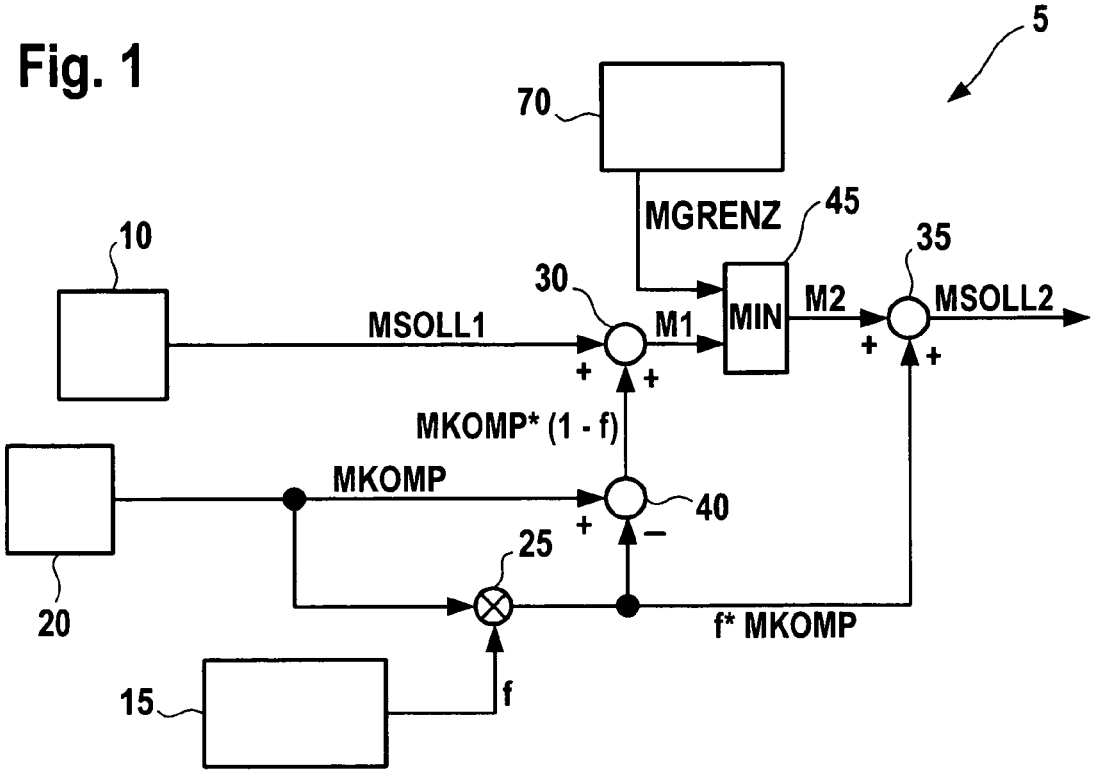
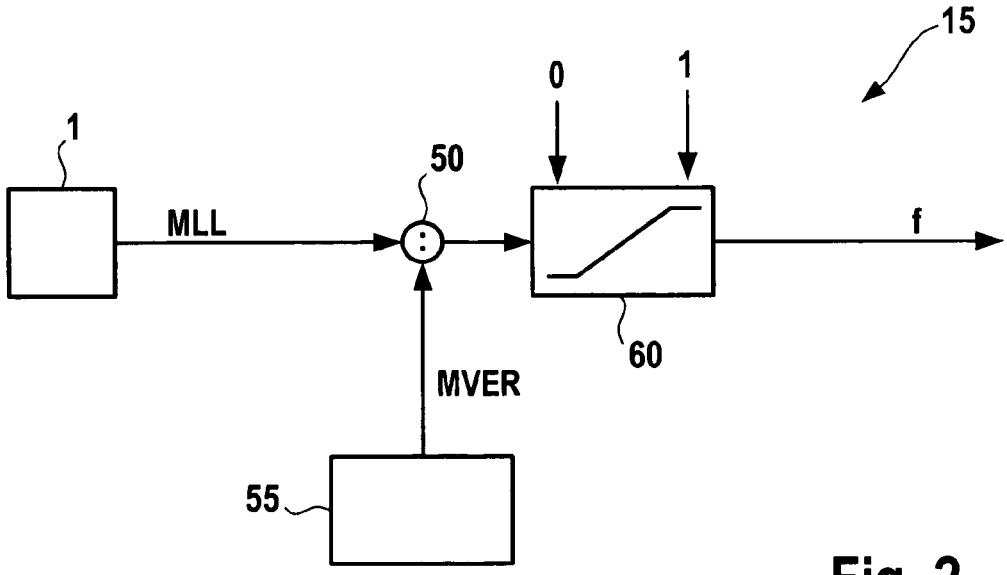
Fig. 2

METHOD AND DEVICE FOR CONTROLLING A DRIVE UNIT

BACKGROUND INFORMATION

Methods are known for controlling a drive unit in which a setpoint value for a drive unit output variable is predefined, it being possible to modify the predefined setpoint value as a function of at least one reducing request and at least one load to be compensated for. For example in the case of propulsion of a motor vehicle by the drive train, it is known that a modeled consumer torque of loads for which compensation is required, e.g., secondary equipment, may be included in calculations at a specified point in the path for determining the setpoint torque of an engine controller. If that point of inclusion in the calculation is before a minimum selection having reducing external interventions, e.g., from a transmission controller or an electronic stability program, limits must be applied to these external interventions if the vehicle's engine is close to idle speed, because the idle-speed controller generally relies on support via the compensation for the modeled consumer torque. If limits are not applied to the external intervention, the inclusion in calculation of the modeled consumer torque is likely to be at least partly reversed by the reducing external interventions. This renders the compensation for the modeled consumer torque at least partly ineffective. Compensation for the modeled consumer torque would then have to be at least partly carried out by the idle-speed controller, but in the case described this design feature is not provided. If the point at which the modeled consumer torque is included in the calculation of the setpoint value is after the reducing external interventions, the reducing external interventions are unable to reduce the engine's total torque to below the modeled consumer torque.

SUMMARY OF THE INVENTION

The method according to the present invention and the device according to the present invention for controlling a drive unit have the advantage that the ratio of a first priority request for modification of the predefined setpoint value as a function of the at least one load to be compensated to a second priority request for modification of the predefined setpoint value as a function of the at least one reducing request may be varied for different drive unit operating states. This means that, based on the operating state of the drive unit, it is possible to prioritize the inclusion in the calculation of the at least one reducing request for determining the predefined setpoint value or the inclusion in the calculation of the at least one load to be compensated for determining the predefined setpoint value. Thus in drive unit operating states requiring load compensation, e.g., to avoid stalling of the drive unit, modification of the predefined setpoint value may be prioritized as a function of the at least one load to be compensated for. In drive unit operating states in which compensating for load presents no difficulties, e.g., if the engine speed is well above idle speed, modification of the predefined setpoint value may be prioritized as a function of the at least one reducing request.

Thus modification of the predefined setpoint value as a function of the at least one reducing request and as a function of the at least one load to be compensated for may be optimally adjusted to the drive unit's operating state.

It is particularly advantageous if the different operating states are defined by a variable measure of the activity level of a drive unit idle-speed controller. This means the drive unit's various operating states may be unambiguously assigned to different levels of need for load compensation, and the ratio of the first priority request to the second priority request may be determined in a particularly simple manner.

As a general rule, as the measure of the idle-speed controller's activity level increases, the engine speed increasingly approaches idle speed; for this reason, as the measure of the idle-speed controller's activity level increases it is necessary to increasingly prioritize load compensation over the at least one reducing request for setting the predefined setpoint value. This may be accomplished advantageously by increasing the first priority request relative to the second priority request as the measure of the idle-speed controller's activity level increases.

If the idle-speed controller is supported by a separate load compensation, e.g., via pre-controlling, it is only necessary for the idle-speed controller to compensate for non-compensated losses. Thus in a particularly advantageous manner the measure of the idle-speed controller's activity level may be determined in a particularly simple manner as a function of a ratio of an idle-speed controller output variable to non-compensated drive unit losses.

In an even simpler manner, if all drive unit losses have been compensated via pre-controlling and the idle-speed controller in steady state only requires correction of the compensation, the idle-speed controller's activity level may be determined as a function of an engine speed.

Load compensation and the at least one reducing request for determining the predefined setpoint value is included in the calculations in an optimal manner as a function of the operating state if, subject to weighting based on the ratio of the first priority request to the second priority request, modification of the predefined setpoint value as a function of the at least one load to be compensated for is performed before a minimum selection having the at least one reducing request and after this minimum selection.

As the need for load compensation increases, in particular as the engine speed approaches idle speed, and therefore as the ratio of the first priority request to the second priority request increases, in a particularly simple manner, the weighting for modification of the predefined setpoint value as a function of the at least one load to be compensated for after the minimum selection may be increased relative to the weighting for modification of the predefined setpoint value as a function of the at least one load to be compensated for prior to the minimum selection. This ensures that, as load compensation becomes increasingly necessary, it is increasingly included in the calculation of the setpoint value for drive unit output after the minimum selection and is thus decreasingly affected by the at least one reducing request.

If the idle-speed controller is used, the weighted inclusion of load compensation in the calculation prior to the minimum selection and after the minimum selection together with the at least one reducing request may be determined in a particularly simple manner if weighting for modification of the predefined setpoint value as a function of the at least one load to be compensated for prior to the minimum selection and weighting for modification of the predefined setpoint value as a function of the at least one load to be compensated for are assigned to the idle-speed controller activity level after the minimum selection.

BRIEF DESCRIPTION OF THE DRAWINGS

FIG. 1 shows a function diagram for an exemplary implementation of the device according to the present invention, and for explaining the method according to the present invention.

FIG. 2 shows a function diagram for a first embodiment for determining a measure of the activity level of an idle-speed controller.

DETAILED DESCRIPTION

Figure 3:
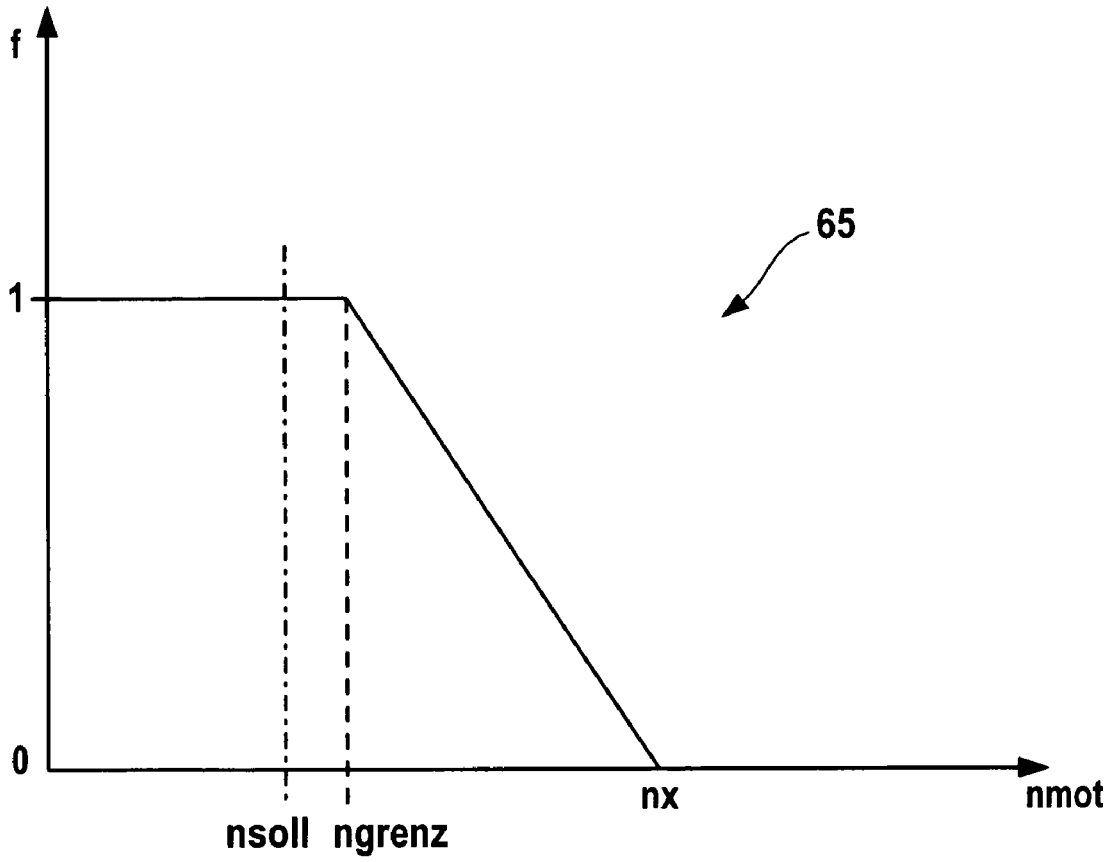
FIG. 3 shows a characteristic curve for ascertaining the measure of the idle-speed controller activity level as a function of an engine speed.

In FIG. 1, reference numeral 5 indicates a device for controlling a drive unit which drives a motor vehicle, for example. Device 5 may be for example an engine controller for the vehicle. FIG. 1 only shows the components of engine controller 5 which are necessary for the functioning of the present invention. Engine controller 5 determines a setpoint value for an output variable of the drive unit. The output variable may be for example a torque or power or a variable derived from the torque and/or power. Below, it is assumed by way of example that the output variable is a torque. Engine controller 5 includes predefinition unit 10 which, in a manner known to those skilled in the art, determines drive unit torque first setpoint value MSOLL1. Predefinition unit 10 may determine drive unit torque first setpoint value MSOLL1 as a function of the driver's intent; this may be determined from the degree of actuation of the vehicle's accelerator pedal. First setpoint value MSOLL1 is sent to first adding element 30. Furthermore, first determination unit 20 is provided, and in a manner known to those skilled in the art determines compensation torque MKOMP, which corresponds to the sum of the torque requirements of secondary vehicle units, e.g., an air-conditioning compressor or servo pump. Compensation torque MKOMP thus constitutes a modeled consumer torque of the load to be compensated for or the vehicle's secondary units. It is supplied to subtracting element 40.

Moreover, at multiplying element 25 compensation torque MKOMP is multiplied by measure f of the activity level of idle-speed controller 1. This measure f is determined by adjustment means 15. The product f*MKOMP, i.e., compensation torque MKOMP weighted with measure f of the activity level of idle-speed controller 1, is then available at the output of multiplying element 25. The output of multiplying element 25 is supplied to second adding element 35. Furthermore, in subtracting element 40 the output of multiplying element 25 is subtracted from compensation torque MKOMP. Therefore the product MKOMP*(1−f), i.e., compensation torque MKOMP weighted with the factor 1−f, is present at the output of subtracting element 40. In first adding element 30, the output of subtracting element 40 is added to first setpoint value MSOLL1, so that first modified setpoint torque M1, or a first modified setpoint value for the torque, is present at the output of first adding element 30.

This is supplied to minimum selection element 45. Limiting torque MGRENZ, which is determined in second determination unit 70 in a manner known to those skilled in the art, is also sent to minimum selection element 45. Limiting torque MGRENZ constitutes a resulting reducing request for the drive unit torque setpoint value to be determined. Limiting torque MGRENZ is determined in second determination unit 70 for example by coordinating a plurality of reducing requests for the drive unit torque setpoint value to be determined, these requirements originating for example from a transmission controller (not shown in FIG. 1) and/or electronic stability program (not shown in FIG. 1). The various reducing requests for the torque setpoint value may be predefined as for example an upper limiting value for the torque setpoint value of various vehicle functions, e.g., transmission controller or vehicle dynamics regulation system. The coordination process in second determination unit 78 may then, for example via minimum selection, select the smallest of these upper limiting values as resulting limiting torque MGRENZ. Next, minimum selection element 45 selects, from the resulting limiting torque MGRENZ and modified setpoint torque M1, the smaller of the two values and outputs it as second modified setpoint torque M2. Thus first modified setpoint torque M1 is limited, in the upwards direction, to resulting limiting torque MGRENZ by minimum selection element 45.

Second modified setpoint torque M2 at the output of minimum selection element 45 is supplied to second adding element 35, where it is added to the output of multiplying element 25. A resulting second drive unit torque setpoint value MSOLL2 is then output as a sum by second adding element 35. This second setpoint value MSOLL2 is then used by engine controller 5 in a manner known to those skilled in the art. If the drive unit is an internal combustion engine, this may take the form of adjustment of the air supply or ignition angle in the case of a spark ignition engine or adjustment of the fuel supply in the case of a diesel engine.

The function diagram shown in FIG. 1 may be implemented in the form of software and/or hardware in engine controller 5. In the function diagram shown in FIG. 1 there are two calculation inclusion points for compensation torque MKOMP. A first of the two calculation inclusion points for compensation torque MKOMP is adding element 30 upstream from minimum selection element 45. A second calculation inclusion point for compensation torque MKOMP is second adding element 35 downstream from minimum selection element 45. At the first calculation inclusion point, i.e., first adding element 30, compensation torque MKOMP and thus the load to be compensated for or secondary equipment connected to the drive unit are weighted using the factor 1−f, and at the second calculation inclusion point, i.e., second adding element 35, they are weighted using the factor f, i.e., the measure of the activity level of idle-speed controller 1. The inequality $0 \leqq f \leqq 1$ applies to the measure. If f=1, compensation torque MKOMP is completely included in the calculation, downstream from minimum selection element 45 at second adding element 35, for determining the resulting drive unit torque setpoint value MSOLL2, i.e., it has complete or maximum priority over intervention by resulting limiting torque MGRENZ at minimum selection element 45. If f=0, compensation torque MKOMP is completely included in the calculation, upstream from minimum selection element 45 at first adding element 34, for generating first modified setpoint torque M1; thus intervention by resulting limiting torque MGRENZ at minimum selection element 45 is able to reduce the resulting drive unit torque second setpoint value MSOLL2 to a level below first modified setpoint torque M1 and is thus able to at least partly reverse the inclusion of compensation torque MKOMP in the calculation of the resulting drive unit torque second setpoint value MSOLL2, rendering it ineffective.

The function diagram in FIG. 2, which also may be implemented as software and/or hardware in engine controller 5, shows an actuator for setting measure f of the activity level of idle-speed controller 1. As shown in FIG. 2, the output variable of idle-speed controller 1 is idle-speed controller setpoint torque MLL. When the engine is idling, idle-speed controller setpoint torque MLL is used to compensate for torque losses for which compensation has not been performed via compensation torque MKOMP, e.g., arising from engine friction. By contrast with idle-speed controller setpoint torque MLL, which is the output variable of the idle-speed controller, drive unit torque first setpoint value MSOLL1, which is output by predefinition unit 10, is a propulsion setpoint torque which furthermore is not generated via regulation but rather via modeling and thus via controlling. Compensation torque MKOMP is taken into account in determination of the resulting drive unit torque second setpoint value MSOLL2, and is thus governed by controlling and pre-controlling; however, MLL idle-speed controller setpoint torque is governed by regulation. As described, the load to be compensated for or secondary equipment is taken into account via compensation torque MKOMP, and the torque losses arising from engine friction as described, for which compensation is not provided via compensation torque MKOMP, are taken into account via idle-speed controller setpoint torque MLL. When the engine is in idle speed, the sum of all torque losses is generated from the sum of idle-speed controller setpoint torque MLL and compensation torque MKOMP, and hence from the sum of torque losses compensated for by MKOMP and arising from loads and secondary equipment and torque losses MVER not compensated for by MKOMP, which may be determined by third determination unit 55 in a manner known to those skilled in the art, as shown in FIG. 2.

When the engine is idling in steady state, i.e., if the engine speed actual value nmot is roughly equal to a setpoint value nsoll for idle speed, idle-speed controller setpoint torque MLL is equal to torque loss MVER, i.e., idle-speed controller 1 completely compensates for losses not compensated for by the controller and thus by compensation torque MKOMP. Thus $$MLL=MVER \tag{1}$$

In the case of drive unit operating states except idle, in which the engine speed actual value nmot is increasingly greater than the idle speed setpoint value nsoll, the idle-speed controller setpoint torque tends to zero. Thus idle-speed controller setpoint torque MLL provides decreasing compensation for torque loss MVER. Drive unit torque second setpoint value MSOLL2 then provides increasing compensation for torque loss MVER to the extent that idle-speed controller setpoint torque MLL decreases. When the engine is in actual idle speed, drive unit torque first setpoint value MSOLL1 is equal to zero, and because the activity level of idle-speed controller 1 is at a maximum when the engine is idling and therefore measure f=1, the resulting drive unit torque second setpoint value MSOLL2 is equal to compensation torque MKOMP. Measure f of the activity level of idle-speed controller 1 may therefore be determined very simply by generating the ratio of idle-speed controller setpoint torque MLL to torque loss MVER. This is implemented via the function diagram shown in FIG. 2. In dividing element 50, idle-speed controller setpoint torque MLL is divided by torque loss MVER. The output variable is supplied to first characteristic curve 60, which maps the output of dividing element 50 to measure f of the activity level of idle-speed controller 1. First characteristic curve 60 may be for example linear and may output the value f=1 for the ratio MLL/MVER=1 and f=0 for the ratio MLL/MVER=0. In that instance f=MLL/MVER (2).

Depending on the priority request or non-priority request for the inclusion of compensation torque MKOMP with respect to the inclusion of limiting torque MGRENZ in the calculation of the resulting drive unit torque second setpoint value MSOLL2, first characteristic curve 60 may also be non-linear, in which case it is generally useful to leave the start value of first characteristic curve 60 at f=0 for MLL=0 and to leave the end value of first characteristic curve 60 at f=1 for MLL=MVER. This is based on the assumption that MVER as a variable essentially remains constant, with a changing idle-speed controller setpoint torque MLL.

The approach shown in FIG. 2 depends on a distinction being drawn between drive unit losses for which compensation is provided via pre-controlling and drive unit losses for which compensation is not provided via pre-controlling. If all losses are to be compensated for via compensation torque MKOMP and thus via pre-controlling, i.e., idle-speed controller 1 in steady state only requires correction of compensation torque MKOMP and therefore idle-speed controller setpoint torque MLL no longer needs to compensate for torque loss MVER, the approach shown in FIG. 2 no longer works. This is because, in such an instance, in steady-state idle speed measure f would be able to take on the value 0 or a value close to zero.

For this reason, in an alternative embodiment of determination unit 15 an engine speed-dependent characteristic curve as shown in FIG. 3 is provided. In this case determination unit 15 would correspond to second characteristic curve 65 as shown for example in FIG. 3. In this case the input variable of determination unit 15 and thus of second characteristic curve 65 is engine speed actual value nmot, and the output variable of determination unit 15 and thus of second characteristic curve 65 is measure f of the activity level of idle-speed controller 1. Provided the engine speed actual value is less than or equal to idle engine speed setpoint value nsoll, measure f=1. In this case, the value f=1 may be retained up to a limiting engine speed ngrenz above idle engine speed setpoint value nsoll if the activity level of idle-speed controller 1 does not significantly drop off as it approaches and reaches limiting engine speed ngrenz, which may be set in a suitable manner on a test bench. It would of course also be feasible for ngrenz to be equal to nsoll. If actual engine speed nmot is greater than ngrenz, f falls in a linear manner as shown in FIG. 3, until it reaches zero at value nx for engine speed actual value nmot, nx being greater than ngrenz. Depending on the priority request or non-priority request for the inclusion of compensation torque MKOMP over inclusion of limiting torque MGRENZ in the calculation of the resulting drive unit torque second setpoint value MSOLL2, measure f may also fall in a non-linear manner from limiting engine speed ngrenz to engine speed nx.

Thus, with the method according to the present invention and the device according to the present invention, for engine controllers having a continuous transition between idle and propulsion and thus continuous phasing-down of the activity level of idle-speed controller 1 via a propulsion intent of the driver or a cruise controller or vice versa in the case of continuous phasing-down of the desired propulsion via the activity of idle-speed controller 1, it is possible, based on measure f of the activity level of idle-speed controller 1, to continuously modify the priority request for the inclusion of compensation torque MKOMP in the calculation of the resulting drive unit torque second setpoint value MSOLL2 relative to the priority request for the inclusion of limiting torque MGRENZ in the calculation of the resulting second setpoint value MSOLL2. Thus, for different drive unit operating states, which are determined for example via a variable measure f of the activity level of idle-speed controller 1 of the drive unit, it is possible to vary the ratio of a first priority request for the generation of the resulting second setpoint value MSOLL2 based on compensation torque MKOMP to a second priority request for the generation of the resulting second setpoint value MSOLL2 as a function of limiting torque MGRENZ. According to the exemplary embodiment, the first priority request is increased relative to the second priority request as measure f of the activity level of idle-speed controller 1 increases.

Thus the ratio of the first priority request to the second priority request is determined via measure f of the activity level of idle-speed controller 1 in the manner described, and is reflected in the weighting of the inclusion in the calculation of compensation torque MKOMP upstream from minimum selection element 45 and downstream from minimum selection element 45. As the ratio of the first priority request relative to the second priority request increases, the weighting of the inclusion of compensation torque MKOMP in the calculation of drive unit torque second setpoint value MSOLL2 after the minimum selection in minimum selection unit 45 increases relative to the weighting of the inclusion of compensation torque MKOMP in the generation of the resulting second setpoint value MSOLL2 prior to the minimum selection in minimum selection element 45.

Thus in the exemplary embodiment described, a weighting for inclusion of compensation torque MKOMP for forming the resulting second setpoint value MSOLL2 upstream from minimum selection element 45 in the form of the factor 1−f, and respectively a weighting for inclusion of compensation torque MKOMP for forming the resulting second setpoint value MSOLL2 downstream from minimum selection element 45 in the form of measure f, are assigned to measure f of the activity level of idle-speed controller 1.

The method according to the present invention and the device according to the present invention for controlling a drive unit may be used not only in diesel or gasoline engines, but also accordingly in any other drive unit (for example electric motors or hybrid drives combining different drive designs). This may be accomplished easily if, in the manner described, a torque or power variable is used as the output variable of the drive unit, this being independent of the specific implementation and the drive design used.

Drive unit torque first setpoint value MSOLL1 may also be formed by predefinition unit 10 for example via a cruise control unit.

What is claimed is:

1. A method for controlling a drive unit, comprising:

predefining a setpoint value for an output variable of the drive unit;

modifying the predefined setpoint value as a function of at least one reducing request and as a function of at least one load to be compensated for; and varying a ratio of a first priority request for the modification of the predefined setpoint value as a function of the at least one load to be compensated for to a second priority request for the modification of the predefined setpoint value as a function of the at least one reducing request, for different drive unit operating states.

2. The method according to claim 1, further comprising determining the different operating states via a variable measure of an activity level of an idle-speed controller of the drive unit.

3. The method according to claim 2, further comprising increasing the first priority request relative to the second priority request as the measure of the activity level of the idle-speed controller increases.

4. The method according to claim 2, wherein the measure of the activity level of the idle-speed controller is determined as a function of a ratio of an output variable of the idle-speed controller to non-compensated drive unit losses.

5. The method according to claim 2, wherein the measure of the activity level of the idle-speed controller is determined as a function of an engine speed.

6. The method according to claim 1, wherein the modification of the predefined setpoint value as a function of the at least one load to be compensated for is performed subject to a weighting based on the ratio of the first priority request to the second priority request prior to a minimum selection having the at least one reducing request and after the minimum selection.

7. The method according to claim 6, wherein, as the ratio of the first priority request relative to the second priority request increases, a weighting of the modification of the predefined setpoint value as a function of the at least one load to be compensated for after the minimum selection increases relative to a weighting of the modification of the predefined setpoint value as a function of the at least one load to be compensated for prior to the minimum selection.

8. The method according to claim 6, further comprising assigning a weighting of the modification of the predefined setpoint value as a function of the at least one load to be compensated for prior to the minimum selection and a weighting of the modification of the predefined setpoint value as a function of the at least one load to be compensated for after the minimum selection to a measure of an activity level of an idle-speed controller of the drive unit.

9. The method according to claim 1, wherein the output variable is one of a torque and a power variable.

10. A device for controlling a drive unit, comprising:

means for predefining a setpoint value for an output variable of the drive unit;

means for modifying the predefined setpoint value as a function of at least one reducing request and as a function of at least one load to be compensated for; and setting means for varying, for different drive unit operating states, a ratio of a first priority request for the modification of the predefined setpoint value as a function of the at least one load to be compensated for to a second priority request for the modification of the predefined setpoint value as a function of the at least one reducing request.

* * * * *